US007381038B2

(12) United States Patent
Hwang et al.

(10) Patent No.: US 7,381,038 B2
(45) Date of Patent: Jun. 3, 2008

(54) CAPACITY-CHANGING UNIT OF ORBITING VANE COMPRESSOR

(75) Inventors: Seon-woong Hwang, Anyang-Si (KR); Dong-won Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 8 days.

(21) Appl. No.: 11/208,529

(22) Filed: Aug. 23, 2005

(65) Prior Publication Data

US 2006/0198749 A1 Sep. 7, 2006

(30) Foreign Application Priority Data

Mar. 4, 2005 (KR) ..... 10-2005-0018278

(51) Int. Cl.
*F01C 1/02* (2006.01)
*F01C 1/063* (2006.01)

(52) U.S. Cl. ..... 418/59; 418/63

(58) Field of Classification Search ..... 418/55.1–55.6, 418/57, 58, 59, 64; 417/310, 212, 213, 283
See application file for complete search history.

(56) References Cited

U.S. PATENT DOCUMENTS 2,899,903 A * 8/1959 Ryder ..... 417/440
3,515,496 A * 6/1970 Eddy ..... 417/440
3,799,707 A * 3/1974 Newton ..... 418/77
4,060,343 A * 11/1977 Newton ..... 417/309
4,621,986 A * 11/1986 Sudo ..... 417/304
4,808,083 A * 2/1989 Watanabe et al. ..... 417/295
4,859,154 A * 8/1989 Aihara et al. ..... 417/295
5,026,257 A * 6/1991 Aihara et al. ..... 417/295
5,051,070 A * 9/1991 Kazaoka et al. ..... 417/295
6,217,306 B1 * 4/2001 Seward et al. ..... 418/270

OTHER PUBLICATIONS

U.S. Appl. No. 11/208,655 to Hwang et al., which was filed on Aug. 23, 2005.
U.S. Appl. No. 11/111,850 to Hwang et al., which was filed on Apr. 22, 2005.

* cited by examiner

*Primary Examiner*—Thomas Denion
*Assistant Examiner*—Douglas J. Duff
(74) *Attorney, Agent, or Firm*—Greenblum & Bernstein, P.L.C.

(57) ABSTRACT

Disclosed herein is a capacity-changing unit of an orbiting vane compressor that is capable of performing normal operation and no-load operation in inner and outer compression chambers through simple manipulation of a rotary valve plate, thereby easily changing the capacity of the compressor according to operation modes. The capacity-changing unit comprises a rotary valve plate disposed between a cylinder and a subsidiary frame for opening or closing a communication channel connected between an inlet port of the cylinder and inner and outer outlet ports of the cylinder as an actuator is rotated in alternating directions. Consequently, the present invention has the effect of reducing power consumption and preventing reduction in service life of the parts of the orbiting vane compressor due to repetitive on/off operation of the orbiting vane compressor, and therefore, improving the performance and reliability of the orbiting vane compressor.

18 Claims, 8 Drawing Sheets

CAPACITY-CHANGING UNIT OF ORBITING VANE COMPRESSOR

BACKGROUND OF THE INVENTION

1. Field of the Invention

The present invention relates to an orbiting vane compressor, and, more particularly, to a capacity-changing unit of an orbiting vane compressor that is capable of performing normal operation and no-load operation in inner and outer compression chambers through simple manipulation of a rotary valve plate, thereby easily changing the capacity of the compressor according to operation modes.

2. Description of the Related Art

Generally, an orbiting vane compressor is constructed to compress refrigerant gas introduced into a cylinder through an orbiting movement of an orbiting vane in the cylinder having an inlet port. Various types of orbiting vane compressors, which are classified based on their shapes, have been proposed.

FIG. 1 is a longitudinal sectional view illustrating the overall structure of a conventional rotary-type orbiting vane compressor. As shown in FIG. 1, a drive unit D and a compression unit P, which is disposed below the drive unit D, are mounted in a shell 1 while the drive unit D and the compression unit P are hermetically sealed. The drive unit D and the compression unit P are connected to each other via a vertical crankshaft 6, which has an eccentric part 6*a*.

The drive unit D comprises: a stator 2 fixedly disposed in the shell 1; and a rotor 3 disposed in the stator 2 for rotating the crankshaft 6, which vertically extends through the rotor 3, when electric current is supplied to the rotor 3.

The compression unit P comprises an orbiting vane 4 for performing an orbiting movement in a cylinder 5 by the eccentric part 6*a* of the crankshaft 6. As the orbiting vane 4 performs the orbiting movement in the cylinder 5, refrigerant gas introduced into the cylinder 5 through an inlet port 51 is compressed. The cylinder 5 has an inner ring 52. Between the inner ring 52 and the inner wall of the cylinder 5 is defined an annular operation space 53. A wrap 40 of the orbiting vane 4 performs an orbiting movement in the operation space 53. As a result, compression chambers are formed at the inside and the outside of the wrap 40, respectively.

At the upper and lower parts of the compression unit P are disposed a main frame 7 and a subsidiary frame 7*a*, which support opposite ends of the crankshaft 6. The subsidiary frame 7*a* has a discharge chamber 8*a*, which is formed by a muffler 8. The discharge chamber 8*a* is connected to a pipe-shaped discharge channel 9, which extends vertically through the compression unit P and the main frame 7, such that the compressed refrigerant gas is discharged into the shell 1 through the discharge channel 9.

Unexplained reference numeral 11 indicates an inlet tube, 12 an outlet tube, and 10*a* an Oldham's ring for preventing rotation of the wrap 40 of the orbiting vane 4.

When electric current is supplied to the drive unit D, the rotor 3 of the drive unit D is rotated, and therefore, the crankshaft 6, which vertically extends through the rotor 3, is also rotated. As the crankshaft 6 is rotated, the orbiting vane 4 attached to the eccentric part 6*a* of the crankshaft 6 performs an orbiting movement.

As a result, the wrap 40 of the orbiting vane 4 performs an orbiting movement in the operation space 53 of the cylinder 5 to compress refrigerant gas introduced into the cylinder 5 through the inlet port 51 in the compression chambers formed at the inside and the outside of the wrap 40, respectively. The compressed refrigerant gas is discharged into the discharge chamber 8*a* through inner and outer outlet ports (not shown) formed at the cylinder 5 and the subsidiary frame 7*a*. The discharged high-pressure refrigerant gas is guided into the shell 1 through the discharge channel 9. Finally, the compressed refrigerant gas is discharged out of the shell 1 through the outlet tube 12.

FIG. 2 is a plan view, in section, illustrating the compressing operation of the conventional orbiting vane compressor shown in FIG. 1.

As shown in FIG. 2, the wrap 40 of the orbiting vane 4 of the compression unit P performs an orbiting movement in the operation space 53 of the cylinder 5, as indicated by arrows, to compress refrigerant gas introduced into the operation space 53 through the inlet port 51. The orbiting movement of the wrap 40 of the orbiting vane 4 will be described hereinafter in more detail.

At the initial orbiting position of the wrap 40 of the orbiting vane 4 of the compression unit P (i.e., the 0-degree orbiting position), refrigerant gas is introduced into an inner suction chamber A1, which is disposed at the inside of the wrap 40, through the inlet port 51, and compression is performed in an outer compression chamber B2, which is disposed at the outside of the wrap 40, while the outer compression chamber B2 does not communicate with the inlet port 51 and an outer outlet port 53*b*. Refrigerant gas is compressed in an inner compression chamber A2, and at the same time, the compressed refrigerant gas is discharged out of the inner compression chamber A2.

At the 90-degree orbiting position of the wrap 40 of the orbiting vane 4 of the compression unit P, the compression is still performed in the outer compression chamber B2, and almost all the compressed refrigerant gas is discharged out of the inner compression chamber A2 through an inner outlet port 53*a*. At this stage, an outer suction chamber B1 appears so that refrigerant gas is introduced into the outer suction chamber B1 through the inlet port 51.

At the 180-degree orbiting position of the wrap 40 of the orbiting vane 4 of the compression unit P, the inner suction chamber A1 disappears. Specifically, the inner suction chamber A1 is changed into the inner compression chamber A2, and therefore, compression is performed in the inner compression chamber A2. At this stage, the outer compression chamber B2 communicates with the outer outlet port 53*b*. Consequently, the compressed refrigerant gas is discharged out of the outer compression chamber B2 through the outer outlet port 53*b*.

At the 270-degree orbiting position of the wrap 40 of the orbiting vane 4 of the compression unit P, almost all the compressed refrigerant gas is discharged out of the outer compression chamber B2 through the outer outlet port 53*b*, and the compression is still performed in the inner compression chamber A2. Also, compression is newly performed in the outer suction chamber B1. When the orbiting vane 4 of the compression unit P further performs the orbiting movement by 90 degrees, the outer suction chamber B1 disappears. Specifically, the outer suction chamber B1 is changed into the outer compression chamber B2, and therefore, the compression is continuously performed in the outer compression chamber B2. As a result, the wrap 40 of the orbiting vane 4 of the compression unit P is returned to the position where the orbiting movement of the orbiting vane 4 is initiated. In this way, a 360-degree-per-cycle orbiting movement of the wrap 40 of the orbiting vane 4 of the compression unit P is accomplished. The orbiting movement of the wrap 40 of the orbiting vane 4 of the compression unit P is performed in a continuous fashion.

Unexplained reference numeral 55 indicates a slider for maintaining the seal between the high-pressure and low-pressure parts.

FIG. 3 is a plan view, in section, illustrating another example of the compression unit of the conventional orbiting vane compressor shown in FIG. 1.

As shown in FIG. 3, an annular operation space 53 is formed in the cylinder 5. The annular operation space 53 has opposite ends separated from each other by a closing part 58. At one end of the operation space 53 is formed a side inlet port 51. At the other end of the operation space 53 are formed inner and outer outlet parts 53*a* and 53*b*.

The wrap 40 is configured such that the length of the wrap 40 is less than that of the operation space 53. The wrap 40 is disposed in the operation space 53 such that a suction channel is formed between the end of the wrap 40 at the inlet port side and the operation space 53. Sealing is maintained between the inner and outer compression chambers by the slider 55 at the end of the wrap 40 at the outlet port side.

The outlet port side operation space 53 has a linear part 59 although the other part of the operation space 53 is approximately formed in the shape of a ring. Consequently, the slider 55 is disposed in the linear part 59 of the operation space 53 such that the slide 55 can be linearly reciprocated. The slider 55 is brought into tight contact with the outlet port side end of the wrap 40 by the discharge pressure of the compressed refrigerant gas, which is discharged through a gas discharge hole 57 of the operation space 53, whereby sealing is maintained between the high-pressure and the low-pressure parts.

Meanwhile, an energy-saving operation of a refrigerating apparatus or an air conditioning apparatus, such as a refrigerator or an air conditioner, is generally performed as follows. When the temperature in the refrigerator or the temperature in a room where the air conditioner is installed reaches a predetermined temperature, the operation of the compressor of the refrigerator or the air conditioner is stopped. When the temperature in the refrigerator or the temperature in the room exceeds the predetermined temperature, on the other hand, the operation of the compressor of the refrigerator or the air conditioner is initiated. In this way, the operation of the compressor is repetitively turned on and off. Generally, power consumption when the operation of the compressor is initiated is greater than power consumption when the compressor is normally operated. Furthermore, interference between the compressed gas in the compressor and the parts of the compressor is caused due to abrupt interruption of the compressor and initiation of the compressor, and therefore, the parts of the compressor are prematurely worn, which reduces the service life of the compressor.

For this reason, it is required to change the capacity of the compressor without the repetitive on/off operation of the compressor as described above. An inverter system may be used to change the capacity of the compressor. In the inverter system, the number of rotations of the motor is controlled to change the capacity of the compressor. However, the inverter system has problems in that expensive electric circuit control devices and relevant parts are needed. Consequently, the manufacturing costs of the compressor are increased, and therefore, the competitiveness of the product is decreased.

SUMMARY OF THE INVENTION

Therefore, the present invention has been made in view of the above problems, and it is an object of the present invention to provide a capacity-changing unit of an orbiting vane compressor having inner and outer compression chambers formed at the inside and the outside of an orbiting vane as the orbiting vane performs an orbiting movement in a cylinder that is capable of performing normal operation and no-load operation in the inner and outer compression chambers through simple manipulation of a rotary valve plate, thereby easily changing the capacity of the compressor according to operation modes.

In accordance with the present invention, the above and other objects can be accomplished by the provision of a capacity-changing unit of an orbiting vane compressor, comprising: a cylinder having a refrigerant gas inlet port and a refrigerant gas outlet port; a wrap of an orbiting vane for performing an orbiting movement in an operation space defined in the cylinder to compress refrigerant gas introduced into the cylinder; a subsidiary frame for supporting one end of the cylinder; and a rotary valve plate disposed between the cylinder and the subsidiary frame for opening or closing a communication channel connected between a cylinder suction hole, which communicates with the inlet port of the cylinder, and the outlet port.

Preferably, the operation space in the cylinder is formed in the shape of a ring having opposite ends separated from each other, the operation space having a linear part formed at one end of the operation space in the tangential direction, and the wrap is configured such that the length of the wrap is less than that of the operation space, the wrap being disposed in the operation space such that an opening is formed between one end of the wrap and the operation space.

Preferably, the operation space of the cylinder is divided into inner and outer compression chambers by the wrap, and the outlet port comprises a pair of inner and outer outlet ports, which communicate with the inner and outer compression chambers, respectively.

Preferably, the capacity-changing unit further comprises: sealing means brought into contact with one end of the wrap, wherein the sealing means is a linear slider for performing a linear reciprocating movement in the linear part of the operation space having linear sliding contact surfaces, the linear slider having one side brought into contact with the end of the wrap of the orbiting vane.

Preferably, the capacity-changing unit further comprises: pressurizing means formed at a cylinder adjacent to the other side of the linear slider for applying pressure to the linear slider such that the linear slider is brought into tight contact with the end of the wrap.

Preferably, the pressurizing means is a gas discharge hole formed in the operation space adjacent to the other side of the linear slider for allowing gas to be discharged therethrough such that pressure created from the discharged gas is applied to the linear slider.

Preferably, the rotary valve plate has a discharge pressure communication hole, which communicates with the gas discharge hole and a gas suction hole of the subsidiary frame.

Preferably, the cylinder is provided at one surface thereof with a valve operation groove, the valve operation groove including the cylinder suction hole and the inner and outer outlet ports of the cylinder.

Preferably, the valve operation groove is formed in the shape of a ring, and the valve operation groove is provided at a predetermined position of the outer circumferential part thereof with a connection part operation groove, the connection part operation groove communicating with the valve operation groove.

Preferably, the valve operation groove is formed in the shape of a sector, and the valve operation groove is provided at a predetermined position of the outer circumferential part thereof with a connection part operation groove, the connection part operation groove communicating with the valve operation groove.

Preferably, the rotary valve plate is formed in the same shape as the valve operation groove, the rotary valve plate has a communication channel for allowing communication between a communication inlet port, which corresponds to the cylinder suction hole, and inner and outer communication outlet ports, which correspond to the inner and outer outlet ports of the cylinder, respectively, and the rotary valve plate is provided at the rear of the communication channel with inner and outer valve outlet ports, which correspond to the inner and outer outlet ports of the cylinder, respectively, the inner and outer valve outlet ports not communicating with the communication channel.

Preferably, the subsidiary frame has inner and outer outlet ports, which communicate with the inner and outer valve outlet ports, respectively.

Preferably, the rotary valve plate is provided at a predetermined position of the outer circumferential part thereof with an actuator connection part, which extends a predetermined length outward such that the actuator connection part is formed in the shape of a lever, and the actuator connection part is rotatably disposed in the connection part operation groove.

Preferably, the actuator connection part is operated by an actuator, and the actuator is a solenoid.

Preferably, the rotary valve plate is provided at one side of the communication inlet port thereof with a suction pressure communication groove, which communicates with the rear surface side of the slider when the no-load operation of the compressor is performed.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
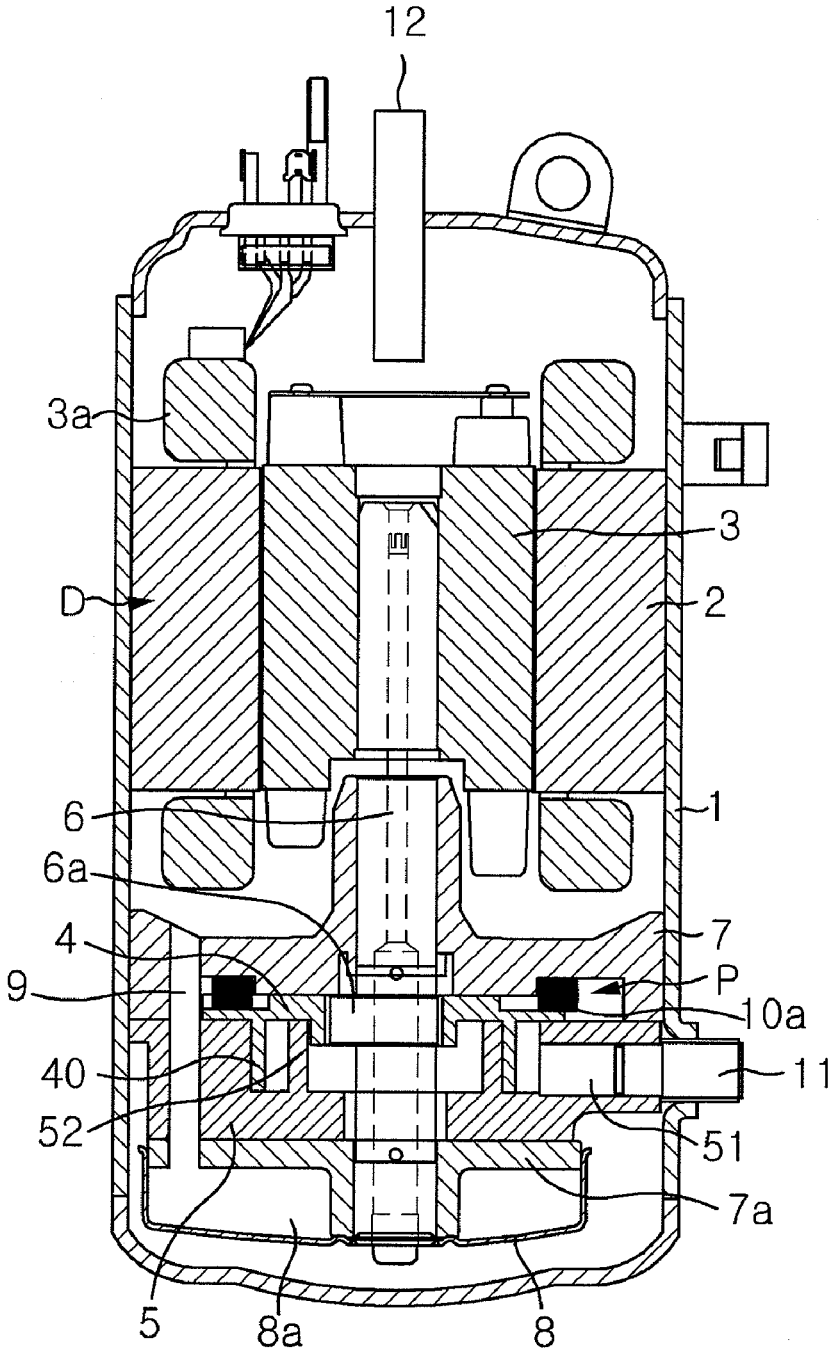
FIG.1 PRIOR ART
FIG. 1 is a longitudinal sectional view illustrating the overall structure of a conventional orbiting vane compressor.
Figure 2:
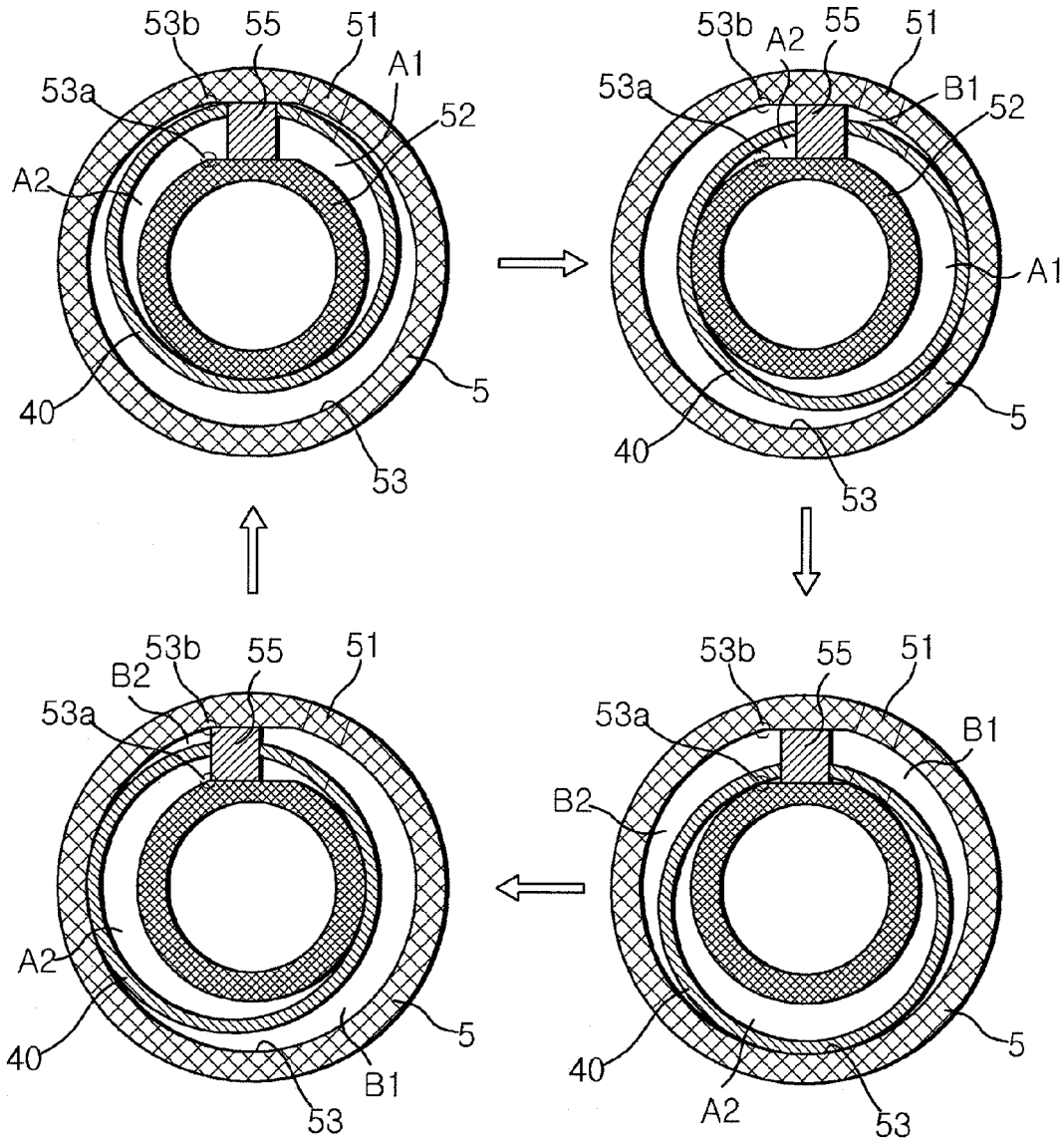
FIG.2 PRIOR ART
FIG. 2 is a plan view, in section, illustrating the compressing operation of the conventional orbiting vane compressor shown in FIG. 1.
Figure 3:
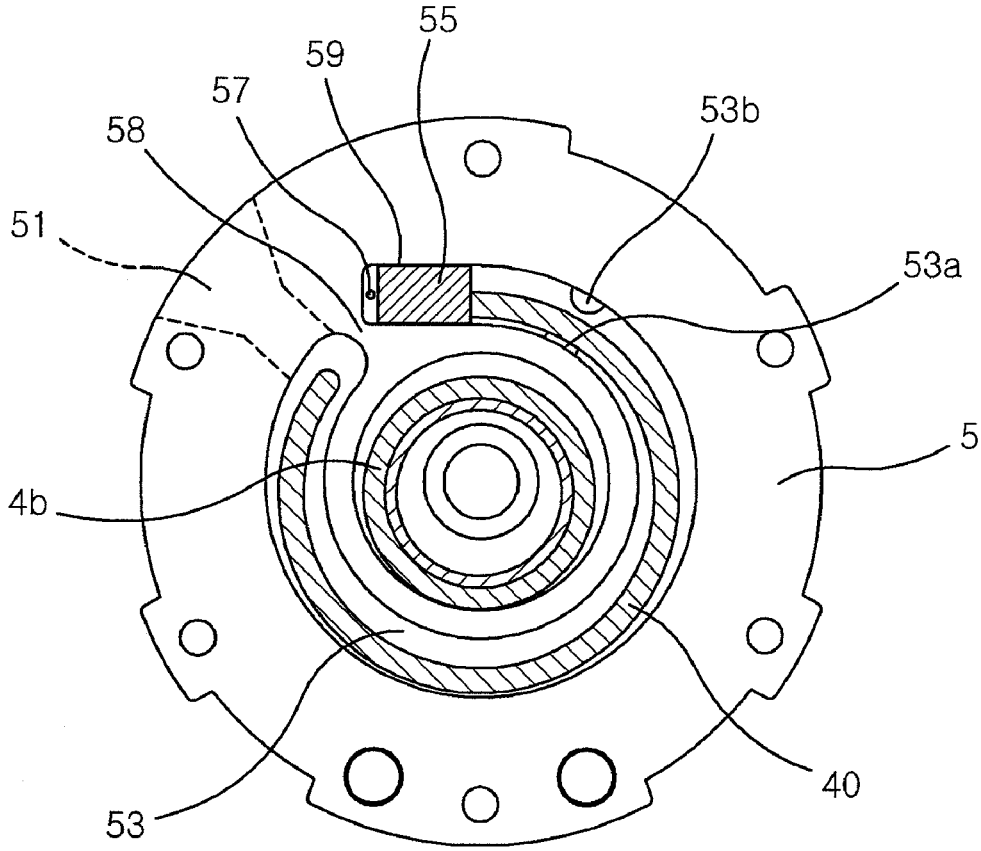
FIG.3 PRIOR ART
FIG. 3 is a plan view, in section, illustrating another example of the compression unit of the conventional orbiting vane compressor shown in FIG. 1.
Figure 4:
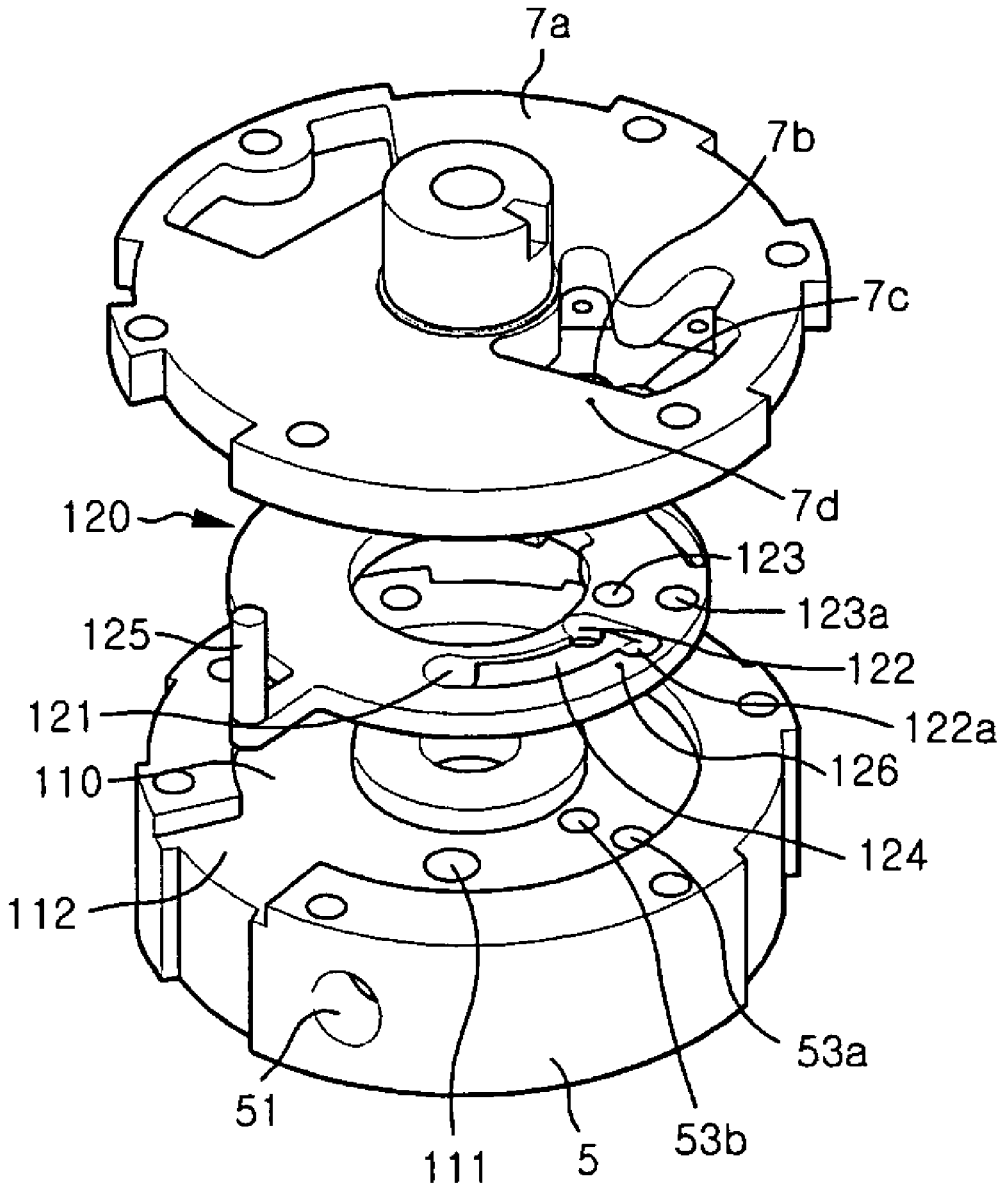
FIG. 4 is an exploded perspective view illustrating a capacity-changing unit of an orbiting vane compressor according to a first preferred embodiment of the present invention.

FIG. 4 is an exploded perspective view illustrating a capacity-changing unit of an orbiting vane compressor according to a first preferred embodiment of the present invention.

At the lower surface of a cylinder 5 is formed a valve operation groove 110 (the valve operation groove 110 is formed at the upper surface of the cylinder 5 in the drawing). The valve operation groove 110 includes a cylinder suction hole 111, which communicates with a side inlet port 51 of the cylinder 5, and inner and outer outlet ports 53*a* and 53*b*, which communicate with inner and outer compression chambers in the cylinder 5. On the valve operation groove 110 is rotatably located a rotary valve plate 120, which is formed in the same shape as the valve operation groove 110.

Figure 5A:
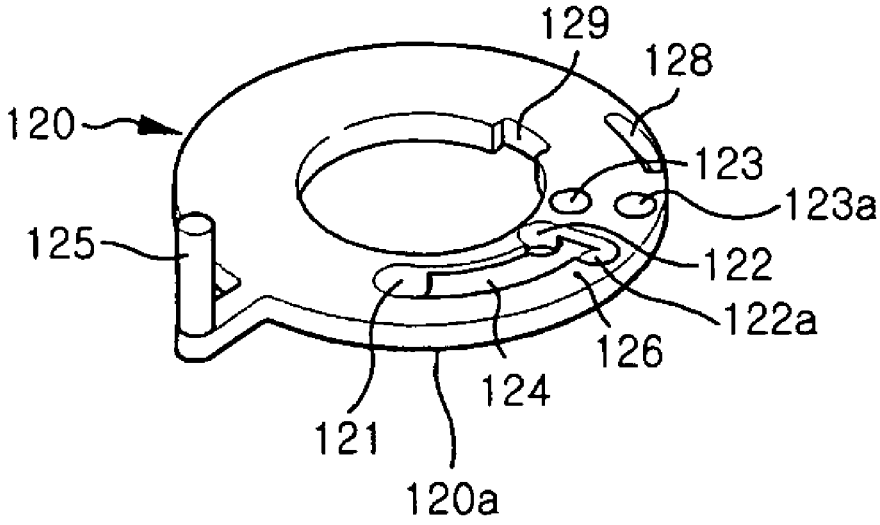
FIG. 5A is a perspective view illustrating the upper part of the rotary valve plate of the capacity-changing unit of the orbiting vane compressor according to the first preferred embodiment of the present invention.

Referring to FIG. 5A, the rotary valve plate 120 includes a communication inlet port 121, which corresponds to the cylinder suction hole 111 of the valve operation groove 110, and inner and outer communication outlet ports 122 and 122*a*, which correspond to the inner and outer outlet ports 53*a* and 53*b* of the cylinder 5, respectively. The communication inlet port 121 communicates with the inner and outer communication outlet ports 122 and 122*a* via a communication channel 124, which is formed in the shape of a groove whose upper part is opened. At the rear of the inner and outer communication outlet ports 122 and 122*a* are formed inner and outer valve outlet ports 123 and 123*a*, respectively, which do not communicate with the communication channel 124. At a predetermined position of the outer circumferential part of the rotary valve plate 120 is provided an actuator connection part 125, which is formed in the shape of a lever. Correspondingly, the valve operation groove 110 is provided at a predetermined position of the outer circumferential part thereof with a connection part operation groove 112, in which the actuator connection part 125 can be rotated in the circumferential direction of the valve operation groove 110. The connection part operation groove 112 communicates with the valve operation groove 110.

A solenoid, which performs a linear reciprocating movement when the solenoid is supplied with electric current, is used as an actuator (not shown). However, any kind of actuator may be used without limits as far as the actuator enables the rotary valve plate 120 to be rotated in alternating directions in the valve operation groove 110 through the actuator connection part 125.

At the subsidiary frame 7*a* and the cylinder 5 are formed a gas suction hole 7*d* and a gas discharge hole 57, respectively, such that the pressure of the compressed refrigerant gas discharged through inner and outer outlet ports 7*b* and 7*c* formed at the inside and the outside of the subsidiary frame 7*a* can be applied to the inside of the operation space 53, which forms a back pressure chamber between the closing part 58 of the cylinder 5 and the slider 55, when the compressor is normally operated. In order to prevent the gas suction hole 7*d* and the gas discharge hole 57 from not communicating with each other by the rotary valve plate 120, a discharge pressure communication hole 126 is also formed at the rotary valve plate 120, which communicates with the gas suction hole 7*d* and the gas discharge hole 57 when the compressor is normally operated.

Figure 5B:
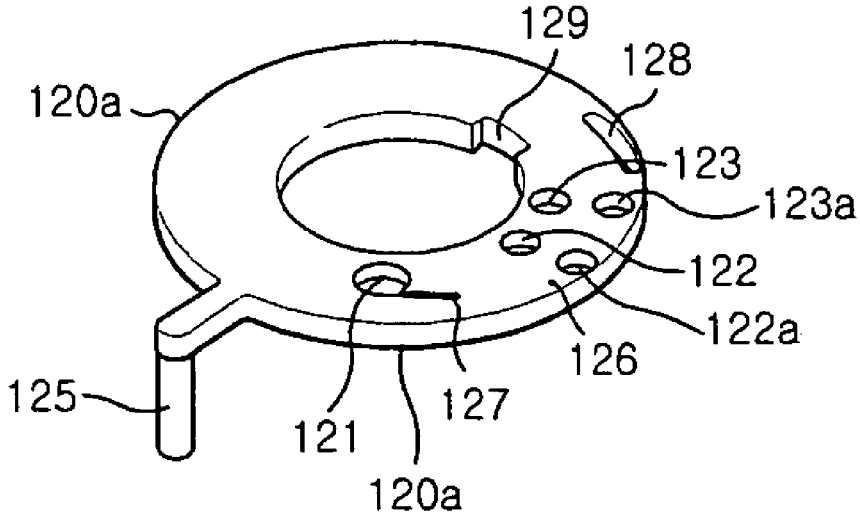
FIG. 5B is a perspective view illustrating the lower part of the rotary valve plate of the capacity-changing unit of the orbiting vane compressor according to the first preferred embodiment of the present invention.

At the communication inlet port 121 of the rotary valve plate 120 is formed a linear suction pressure communication groove 127, which is connected to the rear surface side of the slider 55, as shown in FIG. 5B, such that the suction pressure can be applied to the rear surface of the slider 55 at the other side of the operation space 53 when the no-load operation of the compressor is performed.

Figure 8:
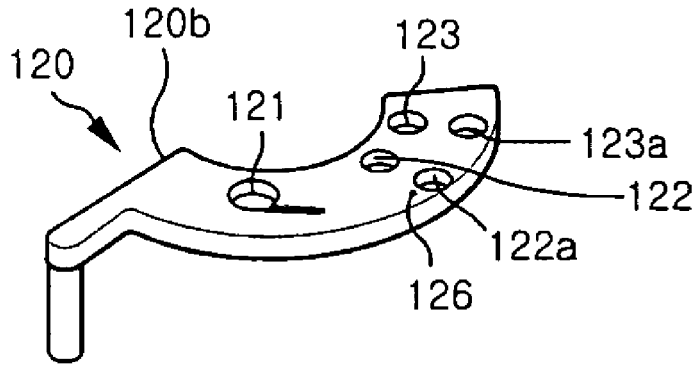
FIG. 8 is a perspective view illustrating the lower part of the rotary valve plate of the capacity-changing unit of the orbiting vane compressor according to the second preferred embodiment of the present invention.

The rotary valve plate 120 may take various forms. For example, the rotary valve plate 120 may be formed in the shape of a ring 120*a*, which corresponds to the valve operation groove 110. Alternatively, the rotary valve plate 120 may be formed in the shape of a sector 120*b*, which will be described below in derail, as shown in FIG. 8. However, it should be noted that the shape of the rotary valve plate 120 is not limited so long as the rotary valve plate 120 can be rotated when power from the actuator is transmitted to the rotary valve plate 120.

Unexplained reference numerals 128 and 129 indicate fixing parts, through which the rotary valve plate 120 is fixed to the cylinder 5 and the subsidiary frame 7*a* by means of bolts. Preferably, the fixing parts 128 and 129 are formed in the shape of an elongated hole or groove, by virtue of which the rotary valve plate 120 can be rotated without interference.

Figure 6A:
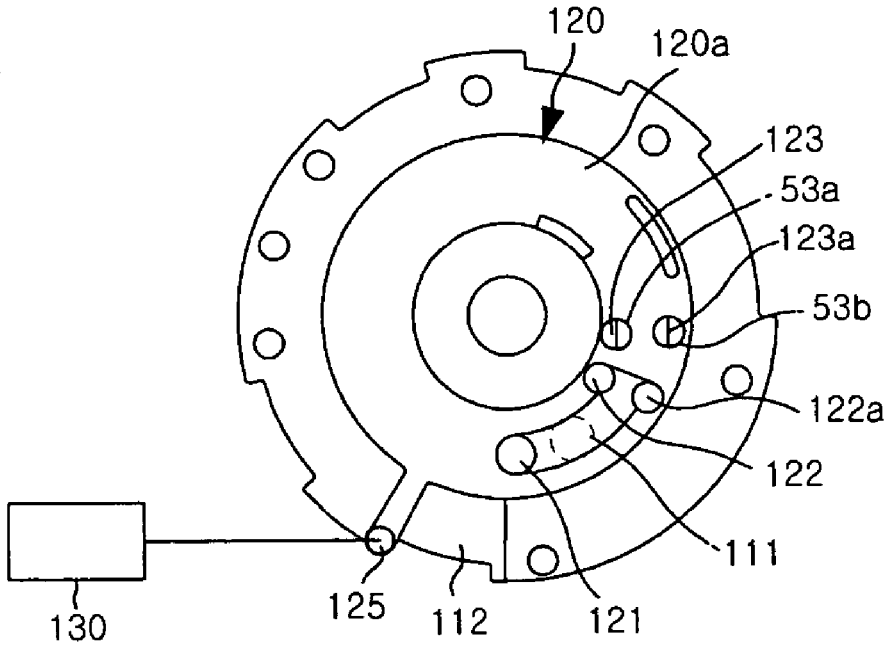
FIG. 6A is a plan view illustrating the normal operation of the capacity-changing unit of the orbiting vane compressor according to the first preferred embodiment of the present invention.
Figure 6B:
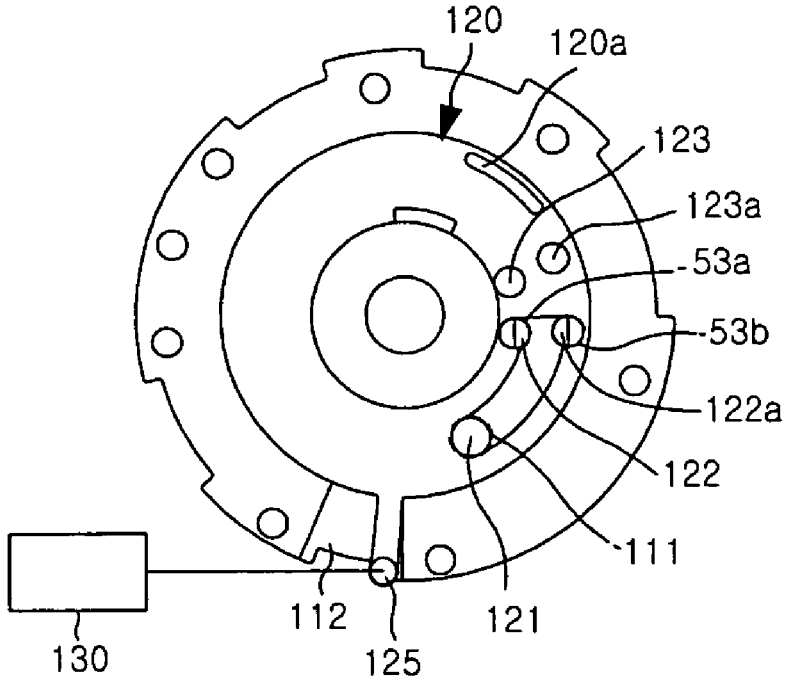
FIG. 6B is a plan view illustrating the no-load operation of the capacity-changing unit of the orbiting vane compressor according to the first preferred embodiment of the present invention.

FIG. 6A is a plan view illustrating the normal operation of the capacity-changing unit of the orbiting vane compressor according to the first preferred embodiment of the present invention, and FIG. 6B is a plan view illustrating the no-load operation of the capacity-changing unit of the orbiting vane compressor according to the first preferred embodiment of the present invention.

When the normal operation of the capacity-changing unit of the orbiting vane compressor is performed as shown in FIG. 6A, the inner and outer valve outlet ports 123 and 123*a* of the rotary valve plate 120 communicate with the inner and outer outlet parts 53*a* and 53*b* of the cylinder 5, respectively. However, the communication inlet port 121 and the inner and outer communication outlet ports 122 and 122*a* in the communication channel 124 of the rotary valve plate 120 do not communicate with the cylinder suction hole 111 and the inner and outer outlet parts 53*a* and 53*b* of the cylinder 5, respectively. As a result, the communication inlet port 121 and the inner and outer communication outlet ports 122 and 122*a* are closed.

Consequently, the refrigerant gas introduced into the cylinder through the side inlet port 51 of the cylinder 5 is compressed in the cylinder 5, and is then discharged out of the cylinder 5 through the inner and outer outlet parts 53*a* and 53*b* of the cylinder 5, the inner and outer valve outlet ports 123 and 123*a* of the rotary valve plate 120, and the inner and outer outlet ports 7*b* and 7*c* of the subsidiary frame 7*a*. In this way, compression is performed in the cylinder 5.

Figure 9:
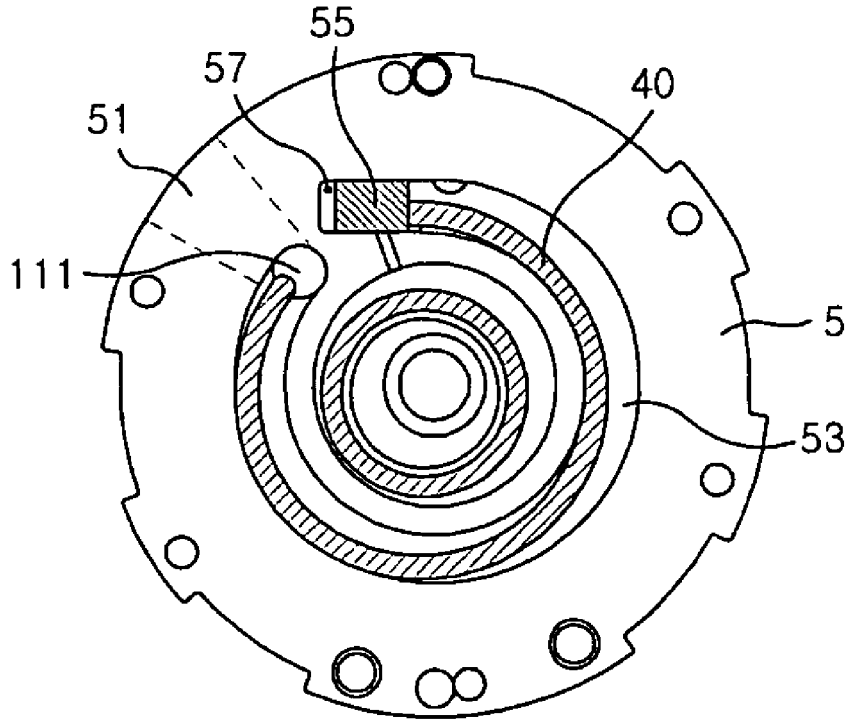
FIG. 9 is a plan view, in section, illustrating the position of the slider of the capacity-changing unit of the orbiting vane compressor according to the present invention based on the discharge pressure.

At this time, the discharge pressure communication hole 126 of the rotary valve plate 120 communicates with the gas suction hole 7*d* of the subsidiary frame 7*a* and the gas discharge hole 57 of the cylinder 5. Consequently, some of the compressed refrigerant gas discharged into the discharge chamber through the inner and outer outlet ports 7*b* and 7*c* of the subsidiary frame 7*a* is discharged into the operation space 53, which forms the back pressure chamber, through the gas suction hole 7*d* of the subsidiary frame 7*a*, the discharge pressure communication hole 126 of the rotary valve plate 120, and the gas discharge hole 57 of the cylinder 5, as shown in FIG. 9. By the pressure created from the discharged gas, the sealing of the slider 55 is accomplished.

Unexplained reference numeral 130 indicates an actuator connected to the actuator connection part 125 of the rotary valve plate 120 for rotating the rotary valve plate 120 in alternating directions.

When the no-load operation of the capacity-changing unit of the orbiting vane compressor is performed as shown in FIG. 6B, on the other hand, the communication inlet port 121 and the inner and outer communication outlet ports 122 and 122*a* of the rotary valve plate 120 communicate with the cylinder suction hole 111 and the inner and outer outlet parts 53*a* and 53*b* of the cylinder 5, respectively. However, the inner and outer valve outlet ports 123 and 123*a* of the rotary valve plate 120 do not communicate with the inner and outer outlet parts 53*a* and 53*b* of the cylinder 5, respectively. As a result, the inner and outer valve outlet ports 123 and 123*a* of the rotary valve plate 120 are closed.

Consequently, the refrigerant gas introduced into the cylinder through the side inlet port 51 of the cylinder 5 is introduced into the communication inlet port 121 of the rotary valve plate 120 through the cylinder suction hole 111, is guided along the communication channel 124, and is then introduced into the cylinder 5 through the inner and outer valve outlet ports 123 and 123*a* of the rotary valve plate 120 and the inner and outer outlet parts 53*a* and 53*b* of the cylinder 5. In this way, the no-load operation is performed.

Figure 10:
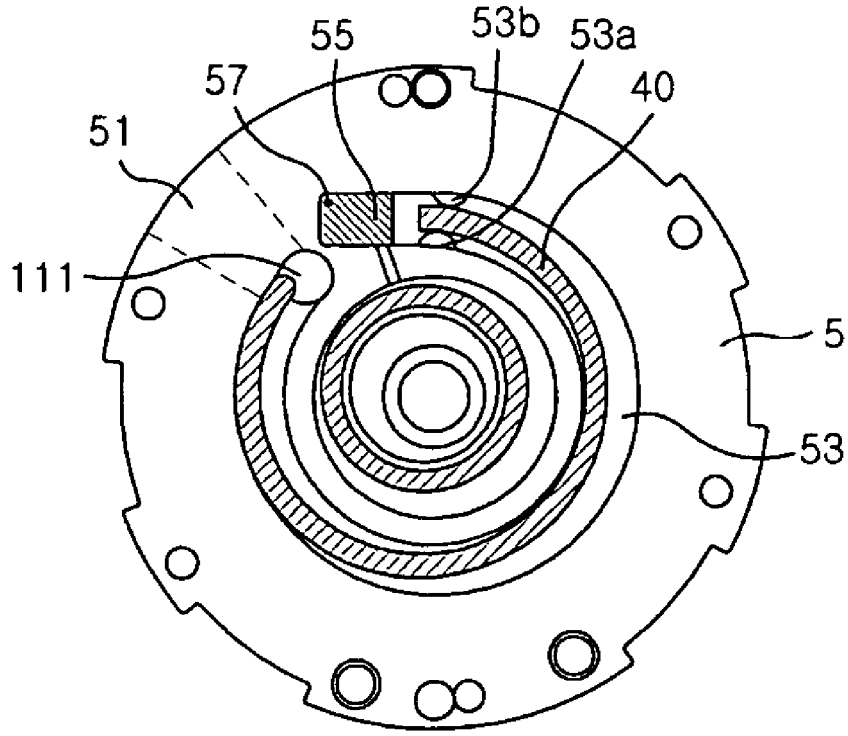
FIG. 10 is a plan view, in section, illustrating the position of the slider of the capacity-changing unit of the orbiting vane compressor according to the present invention based on the suction pressure.

At this time, the end of the suction pressure communication groove 127 of the rotary valve plate 120 is placed at the rear surface of the slider 55. Consequently, the pressure of the refrigerant gas introduced through the side inlet port 51 of the cylinder 5 and the cylinder suction hole 111 is applied to the rear surface of the slider 55 through the suction pressure communication groove 127. At the same time, the slider 55 is brought into tight contact with the end of the linear part 59 of the operation space 53, as shown in FIG. 10. Consequently, the inside part and the outside part of the wrap 40 communicate with each other.

Figure 7:
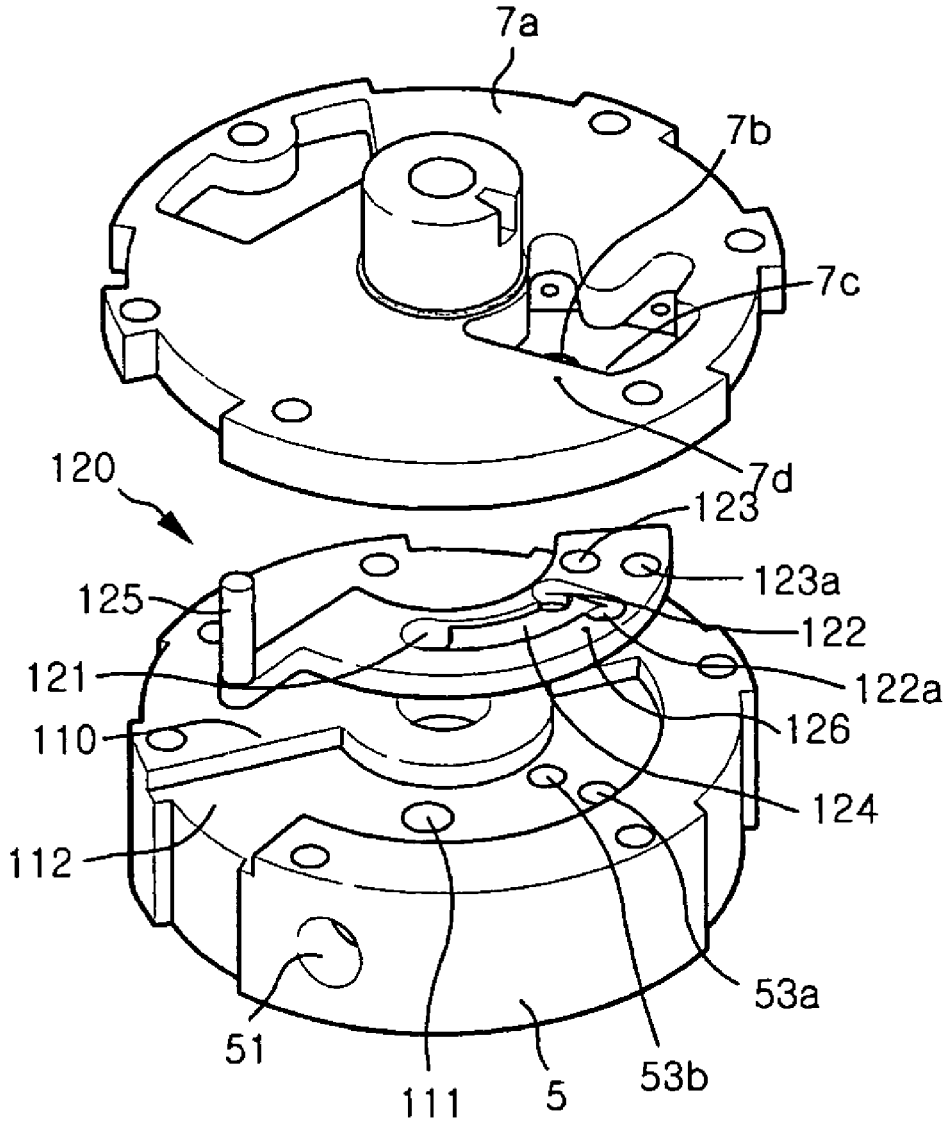
FIG. 7 is an exploded perspective view illustrating a capacity-changing unit of an orbiting vane compressor according to a second preferred embodiment of the present invention.

FIGS. 7 and 8 illustrate a capacity-changing unit of an orbiting vane compressor according to a second preferred embodiment of the present invention. The capacity-changing unit of the orbiting vane compressor according to the second preferred embodiment of the present invention is identical in construction and operation to that of the orbiting vane compressor according to the first preferred embodiment of the present invention except that the rotary valve plate 120 is formed in the shape of a sector 120*b*. Consequently, a detailed description of the capacity-changing unit of the orbiting vane compressor according to the second preferred embodiment of the present invention will not be given. It should be noted, however, that the shape of the rotary valve plate 120 is not limited so long as the rotary valve plate 120 is properly operated.

As apparent from the above description, the present invention provides a capacity-changing unit of an orbiting vane compressor having inner and outer compression chambers formed at the inside and the outside of an orbiting vane as the orbiting vane performs an orbiting movement in a cylinder that is capable of performing normal operation and no-load operation in the inner and outer compression chambers through simple manipulation of a rotary valve plate, thereby easily changing the capacity of the compressor according to operation modes. Consequently, the present invention has the effect of accomplishing economical efficiency of the orbiting vane compressor, reducing power consumption and preventing reduction in service life of the parts of the orbiting vane compressor due to repetitive on/off operation of the orbiting vane compressor, and therefore, improving the performance and reliability of the orbiting vane compressor.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A capacity-changing unit of an orbiting vane compressor, the capacity-changing unit comprising:

a cylinder having a refrigerant gas inlet port, a refrigerant gas outlet port, a cylinder suction hole which communicates with the refrigerant gas inlet port and the refrigerant gas outlet port of the cylinder, and a valve operation groove provided at a surface of the cylinder;

a wrap of an orbiting vane configured to move orbitally within an operation space defined in the cylinder so as to compress refrigerant gas introduced into the cylinder;

a subsidiary frame which supports an end of the cylinder; and a rotary valve plate positioned between the cylinder and the subsidiary frame, the rotary valve plate being configured to rotate relative to the cylinder so as to open and close a communication channel configured to selectively communicate with the cylinder suction hole, wherein the valve operation groove comprises: the cylinder suction hole, inner and outer outlet ports of the cylinder, and a ring shape having a connection part operation groove provided at a predetermined position of the outer circumferential part of the valve operation groove, the connection part operation groove communicating with the valve operation groove, and wherein the rotary valve plate has a shape the same as a shape of the valve operation groove, the communication channel being provided in the rotary valve plate and configured to allow communication between a communication inlet port and the cylinder suction hole, the rotary valve plate having inner and outer communication outlet ports, the inner communication outlet port being configured to communicate with the inner outlet port of the cylinder and the outer communication outlet port being configured to communicate with the outer outlet port of the cylinder, and the rotary valve plate being provided at the rear of the communication channel with inner and outer valve outlet ports, the inner valve outlet port being configured to communicate with the inner outlet port of the cylinder and the outer valve outlet port being configured to communicate with the outer outlet port of the cylinder, wherein the inner and outer valve outlet ports do not communicate with the communication channel.

2. The capacity-changing unit as set forth in claim 1, wherein the operation space in the cylinder comprises a ring shape having a linear part provided at one end of the operation space, the linear part extending in a tangential direction with respect to the ring shape, and the wrap having a circumferential length which is less than that of a circumferential length of the operation space, the wrap being positioned in the operation space so that an opening is provided between an end of the wrap and the operation space.

3. The capacity-changing unit as set forth in claim 2, wherein the wrap divides the operation space of the cylinder into inner and outer compression chambers, and the outlet port of the cylinder comprises inner and outer outlet ports, the inner outlet port communicating with inner compression chamber and the outer outlet port communicating with the outer compression chamber.

4. The capacity-changing unit as set forth in claim 2, further comprising a seal configured to contact an end of the wrap.

5. The capacity-changing unit as set forth in claim 4, wherein the seal comprises a linear slider configured to linearly reciprocate within the linear part of the operation space, the linear slider having linear sliding contact surfaces and a first side surface configured to contact the end of the wrap.

6. The capacity-changing unit as set forth in claim 5, further comprising a pressurizer provided at the cylinder adjacent to a second side of the linear slider, the pressurizer being configured to apply pressure to the linear slider so that the linear slider is brought into is configured to contact the end of the wrap.

7. The capacity-changing unit as set forth in claim 6, wherein the pressurizer comprises a gas discharge hole provided in the operation space adjacent to the second side of the linear slider, the gas discharge hole being configured to discharge gas so that pressure generated by the discharged gas is applied to the linear slider.

8. The capacity-changing unit as set forth in claim 7, wherein the rotary valve plate has a discharge pressure communication hole which communicates with the gas discharge hole and a gas suction hole of the subsidiary frame.

9. The capacity-changing unit as set forth in claim 1, wherein the subsidiary frame has inner and outer outlet ports, the inner outlet port of the subsidiary frame being configured to communicate with the inner valve outlet port and the outer outlet port of the subsidiary frame being configure to communicate with the outer valve outlet port.

10. The capacity-changing unit as set forth in claim 1, wherein a predetermined position of an outer circumferential part of the rotary valve plate is provided with an actuator connection part, the actuator connection part protruding outwardly to provide a lever, and the actuator connection part being rotatably positioned within the connection part operation groove.

11. The capacity-changing unit as set forth in claim 10, further comprising an actuator configured to operate the actuator connection part.

12. The capacity-changing unit as set forth in claim 11, wherein the actuator comprises a solenoid.

13. The capacity-changing unit as set forth in claim 1, wherein the rotary valve plate is provided at one side of the communication inlet port with a suction pressure communication groove, the suction pressure communication groove being configured to communicate with a rear surface side of the slider when a no load operation of the compressor is performed.

14. The capacity-changing unit as set forth in claim 1, wherein the valve operation groove further comprises an arcuate segment.

15. The capacity-changing unit as set forth in claim 14, wherein a predetermined position of an outer circumferential part of the rotary valve plate is provided with an actuator connection part, the actuator connection part protruding outwardly to provide a lever, and the actuator connection part being rotatably positioned within the connection part operation groove.

16. The capacity-changing unit as set forth in claim 15, further comprising an actuator configured to operate the actuator connection part.

17. The capacity-changing unit as set forth in claim 16, wherein the actuator comprises a solenoid.

18. The capacity-changing unit as set forth in claim 14, wherein the rotary valve plate is provided at one side of the communication inlet port with a suction pressure communication groove, the suction pressure communication groove being configured to communicate with a rear surface side of the slider when a no load operation of the compressor is performed.

* * * * *